US006035690A

United States Patent [19]

Murayama

[11] Patent Number: 6,035,690

[45] Date of Patent: Mar. 14, 2000

[54] HOG RING CLAMPING DEVICE

[75] Inventor: Takashi Murayama, Honjo, Japan

[73] Assignee: Meiho Co., Ltd, Tokyo, Japan

[21] Appl. No.: 09/334,723

[22] Filed: Jun. 17, 1999

[30] Foreign Application Priority Data

Jul. 21, 1998 [JP] Japan ..... 10-204775

[51] Int. Cl.[7] ..... B21J 9/18

[52] U.S. Cl. ..... 72/409.02; 72/454; 72/452.8

[58] Field of Search ..... 72/407, 409.02, 72/452.8, 454

[56] References Cited

U.S. PATENT DOCUMENTS

| | | | |
|---|---|---|---|
| 2,727,558 | 12/1955 | Amand | 72/454 |
| 3,537,293 | 11/1970 | Gerlach | 72/409.02 |
| 3,628,230 | 12/1971 | Grise | 72/452.8 |
| 3,830,089 | 8/1974 | Boyd et al. | 72/407 |
| 5,123,273 | 6/1992 | Kawabata | 72/409.2 |
| 5,483,815 | 1/1996 | West | 72/452.8 |
| 5,653,140 | 8/1997 | West | 72/409.02 |
| 5,709,124 | 1/1998 | Murayama | 72/409.03 |
| 5,720,199 | 2/1998 | Dischler | 72/453.03 |

*Primary Examiner*—David Jones

*Attorney, Agent, or Firm*—Birch, Stewart, Kolasch & Birch, LLP

[57] ABSTRACT

A hog ring clamping device which clamps a hog ring such as a C ring, comprising a magazine attached around a clamping portion of a clamping device main body, jaws to deform a C ring, provided in the clamping device main body, a moving rod to open and close the jaws by linear movement, a motor provided in the clamping device main body, and a linear movement converter to convert rotation of the motor into linear movement of the moving rod.

14 Claims, 4 Drawing Sheets

HOG RING CLAMPING DEVICE

BACKGROUND OF THE INVENTION

1. Field of the Invention

The present invention relates to a hog ring clamping device which clamps a hog ring such as a C ring used for attaching a covering material to a member such as a spring of a sheet of a vehicle.

2. Description of the Prior Art

In a conventional C ring clamping device, a magazine for loading C rings is attached to a clamping device main body. The clamping device main body has jaws to deform the C ring, a pneumatic cylinder to open/close the jaws and a directional control valve connected to the pneumatic cylinder. A grip is provided in a lower portion of the clamping device main body. The grip includes an air supply passage connected to an air feed port of the directional control valve. The grip includes a first air discharge passage connected to a first discharge port of the directional control valve. The first air discharge passage opens in a lower portion of the grip. Further, the clamping device main body has a second air discharge passage connected to a second discharge port of the directional control valve. The second air discharge passage opens in a back portion of the clamping device main body.

In the C ring clamping device, the pneumatic cylinder is expanded and contracted by operating the directional control valve, the jaws are opened and closed, the C ring is deformed, and matters to be clamped are clamped by the deformed C ring.

However, as the C ring clamping device requires a compressed air supply device, the place where the C ring clamping operation can be performed is limited. Further, the C ring clamping device generates large air discharge noise every time the directional control valve is operated to deteriorate the working environment of a place where the C ring clamping device is used for clamping work using C rings.

SUMMARY OF THE INVENTION

It is an object of the present invention to provide a hog ring clamping device which enables hog ring clamping without limiting clamping place and improves working environment for hog ring clamping.

According to the present invention, the foregoing object is attained by providing a hog ring clamping device comprising: a clamping device main body; a magazine attached to the clamping device main body; jaws provided in the clamping device main body, which open and close by linear movement of a moving rod; and electric linear movement means for linearly moving the moving rod.

In the hog ring clamping device, as a compressed air supply device is not required, the place where hog ring clamping operation can be performed is not limited. Further, as a large noise due to air discharge does not occur, hog ring clamping working environment can be improved.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Figure 1:
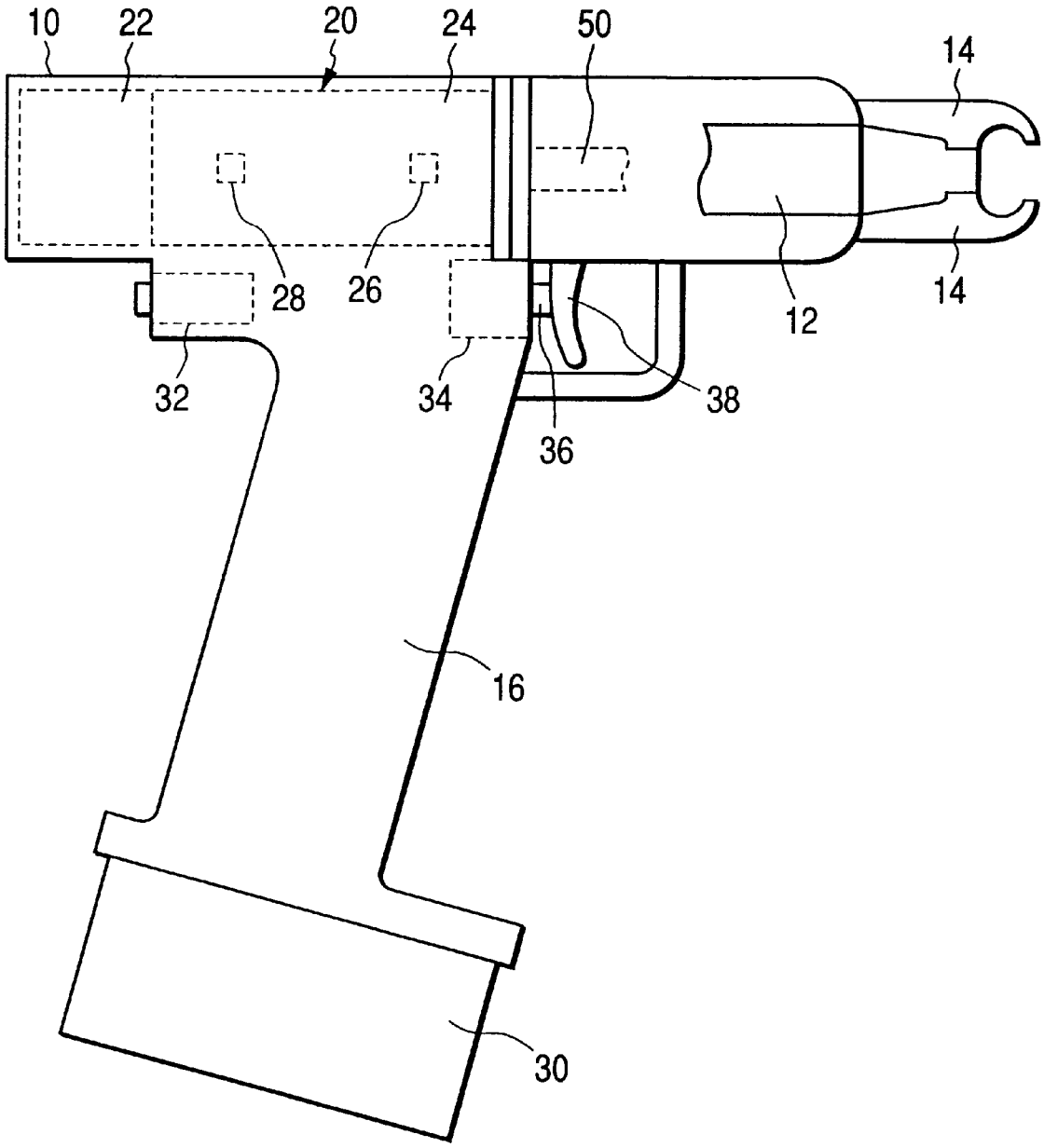
FIG. 1 is a schematic diagram showing a C ring clamping device according to the present invention.
Figure 2:
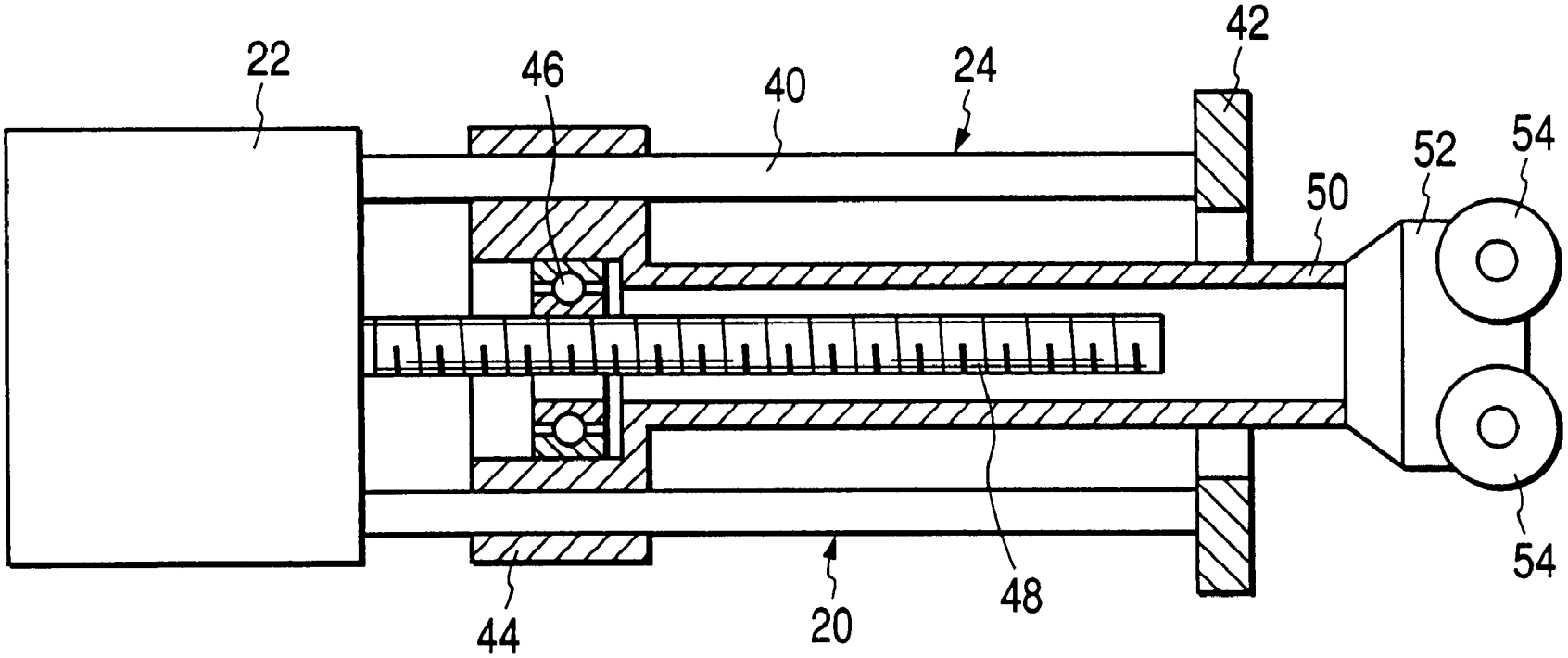
FIG. 2 is a diagram showing a part of the C ring clamping device in FIG. 1.
Figure 3:
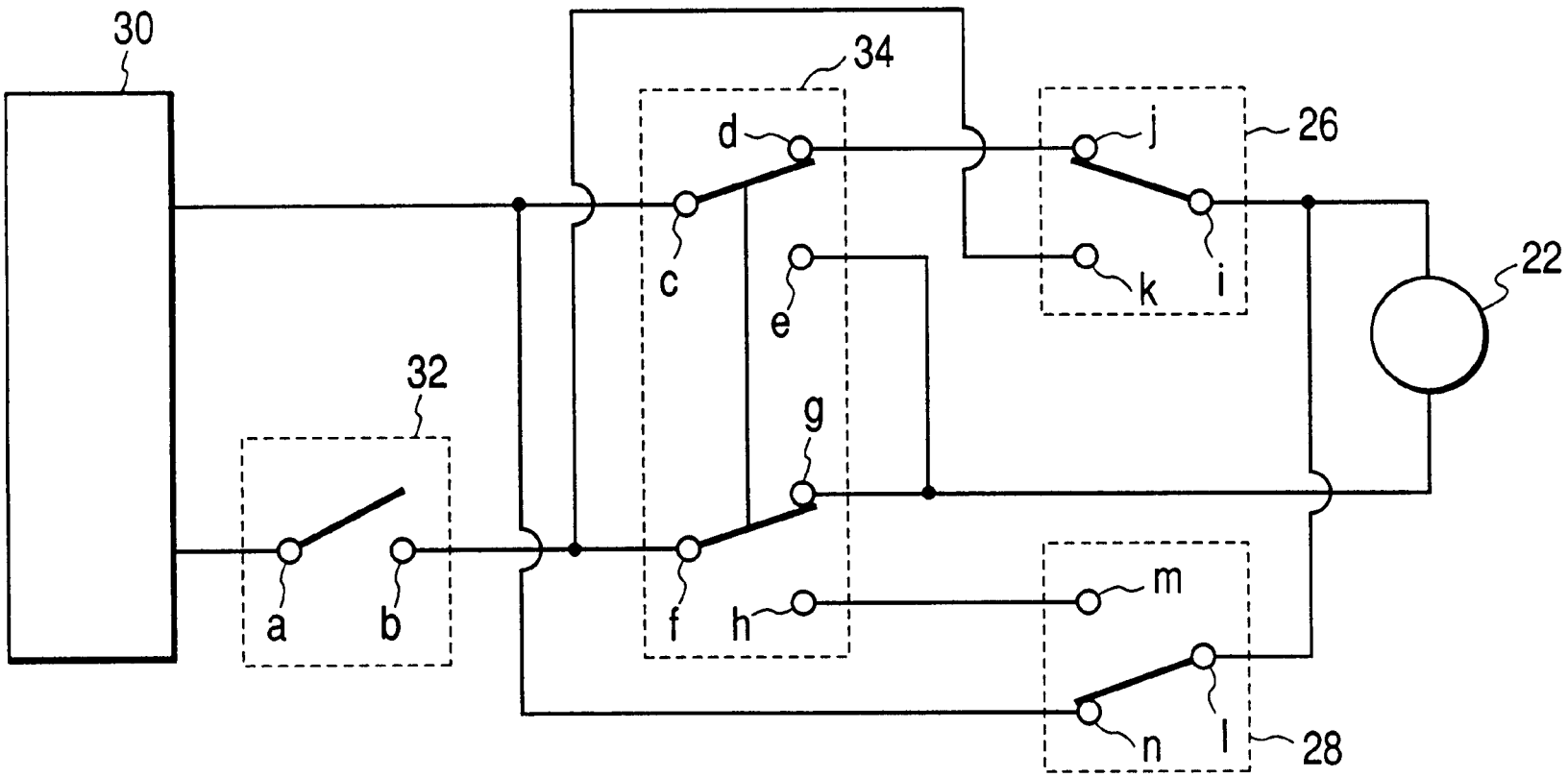
FIG. 3 is a schematic diagram showing electric wiring of the C ring clamping device in FIGS. 1 and 2.

FIGS. 1 to 3 show a C ring clamping device according to the present invention. As shown in FIG. 1, a magazine 12 is attached around a clamping portion of a clamping device main body 10, and a C ring feeding device (not shown) to feed a C ring (not shown) loaded on the magazine 12 is provided. Further, jaws 14 to deform the C ring is openably/closably provided in a clamping portion of the clamping device main body 10, and a grip 16 is provided in a lower portion of the clamping device main body 10.

Further, a direct current motor 22 which reversely rotates by polarity change of input current is provided in the clamping device main body 10. The motor 22 has a thermoprotector which stops rotation when the motor 22 is overheated. Further, a linear movement converter 24 which converts the rotation of the motor 22 into linear movement of a moving rod 50 is provided. Limit switches 26 and 28 are fixed to the linear movement converter 24. Thus, the motor 22 and the linear movement converter 24 construct electric linear movement means 20 for linearly moving the moving rod 50.

Further, a rechargeable battery 30 is removably attached to the grip 16. A power source switch 32 is provided in the clamping device main body 10. The power source switch 32 has a overcurrent prevention device. Further, the clamping device main body 10 has a push-button type changeover switch 34, with a push button 36 which projects from the clamping device main body 10, and a trigger 38 to push the push button 36.

Further, as shown in FIG. 2, guide rods 40 are fixed to the motor 22. A plate 42 is fixed to ends of the guide rods 40. A moving member 44 is movably supported by the guide rods 40. A bearing 46 is fixed to the moving member 44. A female screw is provided on an inner circumferential surface of the bearing 46. A male screw 48 having a diameter smaller than an inner diameter of the bearing 46 is provided on an output shaft of the motor 22. The female screw of the bearing 46 and the male screw 48 are engaged with each other. The guide rods 40, the moving member 44, the bearing 46, the male screw 48 and the like construct the linear movement converter 24. The female screw of the bearing 46, the male screw 48 and the like construct deceleration means. Further, the limit switches 26 and 28 are switched by movement of the moving member 44.

Further, a first moving rod 50 is provided on the moving member 44. A roller support member 52 is provided on the end of the moving rod 50. Rollers 54 are attached to the roller support member 52. The rollers 54 are in contact with the jaws 14. When the moving rod 50 moves forward, i.e., in the rightward direction in FIGS. 1 and 2, the jaws 14 open, and the first C ring loaded on the magazine 12 is conveyed to a front end portion of the jaws 14. Further, when the moving rod 50 moves backward, i.e., in the leftward direction in FIGS. 1 and 2, the jaws 14 close.

Further, as shown in FIG. 3, the power source switch 32, the changeover switch 34, the limit switches 26 and 28 are connected between the battery 30 and the motor 22. When the power source switch 32 is turned on, contacts a and b are connected in the power source switch 32. On the other hand, when the power source switch 32 is turned off, the contacts a and b are not connected in the power source switch 32. Further, when the trigger 38 is not depressed, contacts c and d are connected and contacts f and g are connected in the changeover switch 34. On the other hand, when the trigger 38 is depressed, the contacts c and e are connected and the contacts f and h are connected in the changeover switch 34. Further, in the limit switch 26, normally, contacts i and j are connected. When the moving member 44 moves forward to press a projection of the limit switch 26, the contacts i and k are connected in the limit switch 26. Further, in the limit switch 28, normally, contacts l and m are connected. When the moving member 44 moves backward to press a projection of the limit switch 28, the contacts 1 and n are connected in the limit switch 28.

In the C ring clamping device, in a case where the power source switch 32 is off, the moving member 44 is positioned in a rear part pressing the projection of the limit switch 28, and the trigger 30 is not depressed, the states of the power source switch 32, the changeover switch 34, the limit switches 26 and 28 are as shown in FIG. 3. In these states, if the power source switch 32 is turned on, the contacts a and b of the power source switch 32 are connected, the motor 22 rotates forward, the moving member 44 and the moving rod 50 move forward. At this time, the moving member 44 does not press the projection of the limit switch 28 any more, and the contact l and m of the limit switch 28 are connected. Further, the jaws 14 open, and the first C ring loaded on the magazine 12 is fed to the front end portion of the jaws 14. When the moving member 44 presses the projection of the limit switch 26, the contact i and j of the limit switch 26 are disconnected, and a current from the battery 30 is interrupted. Further, the contacts i and k of the limit switch 26 are connected, then a current flows through the circuit from the motor 22 as an electric power generator, then brakeage is applied to the motor 22, and the motor 22 stops. When the trigger 38 is depressed from this status, the contacts c and e, and the contacts f and h of the changeover switch 34 are connected. Then the motor 22 reversely rotates, the moving member 44 and the moving rod 50 move backward. As the moving member 44 does not press the projection of the limit switch 26 any more, the contact i and j of the limit switch 26 are connected, the jaws 14 close again, the C ring is deformed, and matters to be clamped (not shown) are clamped by the deformed C ring. When the moving member 44 presses the projection of the limit switch 28, the contacts l and m of the limit switch 28 are disconnected, and the current from the battery 30 is interrupted. Then the contacts l and n of the limit switch 28 are connected, then brakeage is applied to the motor 22, and the motor 22 stops. In this status, if an operator's finger is released from the trigger 38, the contacts c and d, and the contacts f and g of the changeover switch 34 are connected, the motor 22 rotates forward, and the moving member 44 and the moving rod 50 move forward. As the moving member 44 does not press the projection of the limit switch 28 any more, the contact l and m of the limit switch 28 are connected. The jaws 14 open and the next C ring is conveyed to the front end portion of the jaws 14. Then, when the moving member 44 presses the projection of the limit switch 26, the contacts i and j of the limit switch 26 are disconnected, the current from the battery 30 is interrupted. The contacts i and k of the limit switch 26 are connected, then brakeage is applied to the motor 22, and the motor 22 stops. In this manner, when the trigger 38 is depressed, the C ring is deformed by the jaws. On the other hand, when the operator's finger is released from the trigger 38, the next C ring is conveyed to the front end portion of the jaws 14. Further, when the trigger 38 is depressed, the motor 22 reversely rotates, and the jaws 14 start to close to deform the C ring. However, if the operator releases the finger from the trigger 38 before the moving member 44 presses the projection of the limit switch 28, the motor 22 immediately changes the rotation direction and rotates forward, and the moving member 44 and the moving rod 50 change the moving direction and move forward. The jaws 14 starting to close immediately start to open. Thus, the deformation of C ring can be stopped.

In the C ring clamping device having the above construction, as a compressed air supply device is not required, the place where C ring clamping operation can be performed is not limited. Further, as air is not discharged at every clamping operation, a loud noise due to air discharge does not occur. Thus, the C ring clamping working environment can be improved. Further, as the linear movement converter 24 has the deceleration means, the moving rod 50 moves comparatively slowly, accordingly, the jaws 14 open and close comparatively slowly. By this arrangement, as the C ring deformation can be stopped in the middle of the operation, the C ring clamping can be stopped in the middle of the operation. Thus, the C ring clamping operation can be performed safely, and the degree of C ring clamping can be controlled. Further, as the rechargeable battery 30 is removably attached to the grip 16, the device can be used even in a place without a power source. Further, when the contacts i and k of the limit switch 26 are connected, and when the contacts l and n of the limit switch 28 are connected, a short circuit is formed, brakeage is applied to the motor 22, and the motor 22 immediately stops. Further, as the power source switch 32 having the overcurrent prevention device is provided between the battery 30 and the changeover switch 34, even if the changeover switch 34 is broken and short-circuited, overload is not applied to the battery 30, and the wires are not burnt due to the overload.

Figure 4:
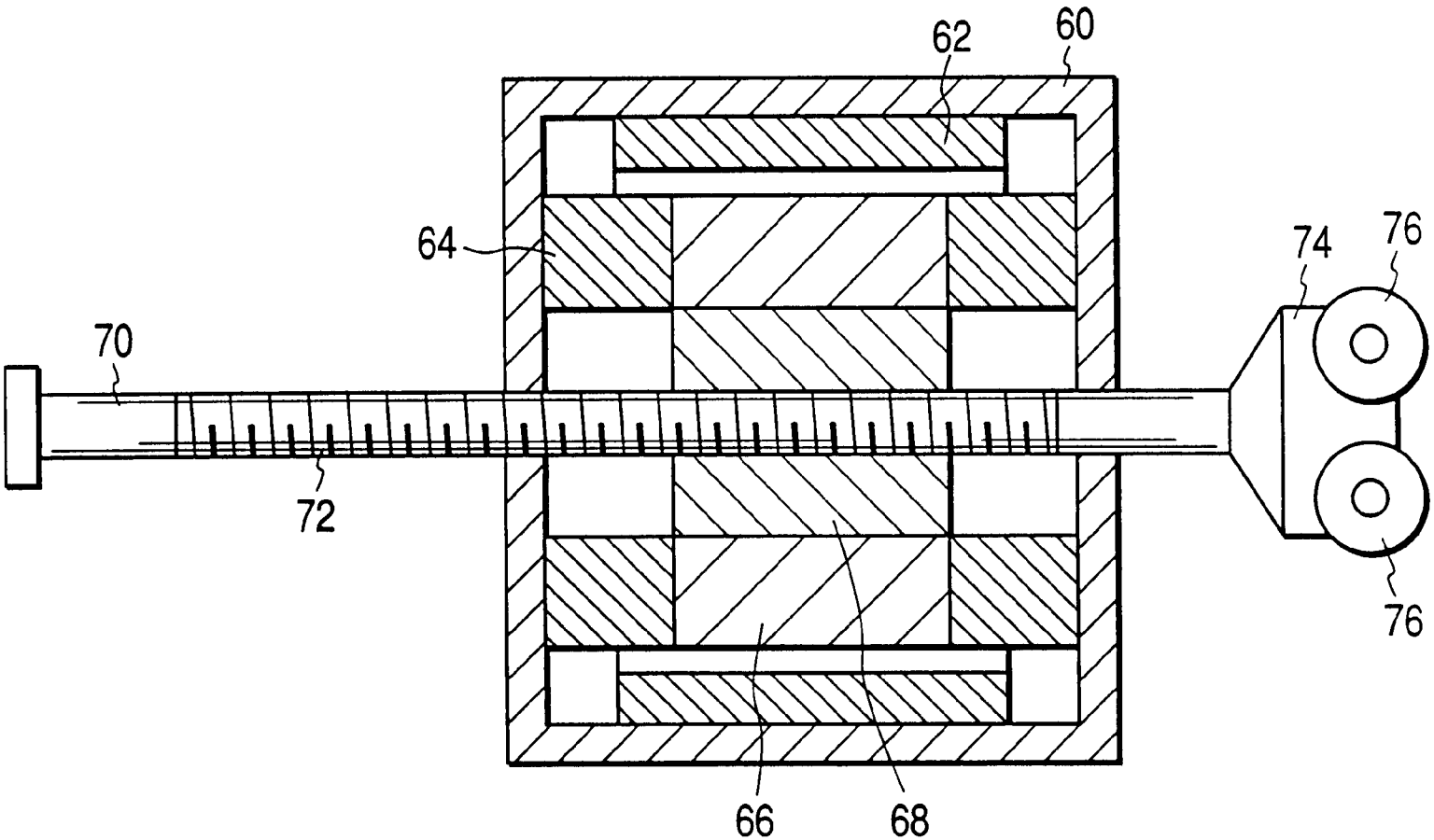
FIG. 4 is a schematic cross-sectional view showing electric linear movement means of another C ring clamping device according to the present invention.

FIG. 4 shows the electric linear movement means of another C ring clamping device according to the present invention. As shown in FIG. 4, a magnet 62 is attached to a motor main body 60 attached to the clamping device main body. A rotating member 66 is rotatably supported via a support member 64 by the motor main body 60. The magnet 62, the rotating member 66 and the like construct the motor. Further, a female screw 68 is attached to the rotating member 66. A second moving rod 70 is supported by the motor main body 60, movably in leftward and rightward directions in FIG. 4, but unrotatably. A male screw 72 is provided on the moving rod 70. The female screw 68 and the male screw 72 engage with each other. The female screw 68, the male screw 72 and the like construct the linear movement converter. Further, a roller support member 74 is provided on the end of the moving rod 70. Rollers 76 are attached to the roller support member 74. The rollers 76 are in contact with the jaws 14. When the moving rod 70 moves forward, i.e., in the rightward direction in FIG. 4, the jaws 14 open, and the first C ring loaded on the magazine 12 is conveyed to the front end portion of the jaws 14. If the moving rod 70 moves backward, i.e., in the leftward direction in FIG. 4, the jaws 14 close.

In the C ring clamping device having the above construction, when the rotating member 66 is rotated forwardly, the moving rod 70 moves forward, the jaws 14 open, and the C ring is conveyed to the front end portion of the jaws 14. When the rotating member 66 is rotated reversely, the moving rod 70 moves backward, the jaws 14 close, the C ring is deformed, and matters to be clamped are clamped by the deformed C ring.

Note that in the above embodiment, the limit switches 26 and 28 are fixed to the linear movement converter 24, however, if the limit switches are position-adjustably attached to the linear movement converter 24, the extent of opening/closing of the jaws 14 can be controlled. Thus, the degree of clamping by the C ring can be controlled. Further, in the above embodiment, the limit switches 26 and 28 are provided on the linear movement converter 24, however, the limit switches may be provided around the front end portion of the jaws 14 of the clamping device main body 10.

The present invention is not limited to the above embodiments and various changes and modifications can be made within the spirit and scope of the present invention. Therefore, to appraise the public of the scope of the present invention, the following claims are made.

What is claimed is:

1. A hog ring clamping device comprising:

a) a clamping device main body;

b) a magazine attached to said clamping device main body;

c) jaws provided in said clamping device main body;

d) a motor provided in said clamping device main body;

e) guide rods fixed to said motor;

f) a moving member movably supported by said guide rods;

g) a bearing fixed to said moving member;

h) a female screw provided on an inner circumferential surface of said bearing;

i) a male screw, provided on an output shaft of said motor, having an outer diameter smaller than an inner diameter of said bearing and engaged with said female screw;

j) a first moving rod provided on said moving member;

k) a roller support member provided on an end of said first moving rod; and l) rollers attached to said roller support member and in contact with said jaws.

2. The hog ring clamping device according to claim 1, further comprising a thermoprotector which stops rotation of said motor when said motor is overheated.

3. The hog ring clamping device according to claim 1, further comprising limit switches switched by movement of said moving member.

4. The hog ring clamping device according to claim 3, wherein said limit switches are position-adjustably attached to said device.

5. The hog ring clamping device according to claim 1, wherein a grip is provided in a lower portion of said clamping device main body, and wherein a rechargeable battery connected to said motor is removably attached to said grip.

6. The hog ring clamping device according to claim 5, wherein a power source switch connected to said battery is provided in said clamping device main body.

7. The hog ring clamping device according to claim 6, wherein said power source switch has an overcurrent prevention device.

8. The hog ring clamping device according to claim 6, wherein a push-button type changeover switch, connected to said power source switch, is provided in said clamping device main body, and a push button of said changeover switch projects from said clamping device main body, and wherein a trigger to push said push button is provided.

9. A hog ring clamping device comprising:

a) a clamping device main body;

b) a magazine attached to said clamping device main body;

c) jaws provided in said clamping device main body;

d) a motor provided in said clamping device main body;

e) a female screw attached to a rotating member of said motor;

f) a second moving rod supported by a motor main body of said motor, movably but unrotatably;

g) a male screw, provided on said second moving rod, and engaged with said female screw;

h) a roller support member provided on an end of said second moving rod; and i) rollers attached to said roller support member and in contact with said jaws.

10. The hog ring clamping device according to claim 9, further comprising a thermoprotector which stops rotation of said motor when said motor is overheated.

11. The hog ring clamping device according to claim 9, wherein a grip is provided in a lower portion of said clamping device main body, and wherein a rechargeable battery connected to said motor is removably attached to said grip.

12. The hog ring clamping device according to claim 11, wherein a power source switch connected to said battery is provided in said clamping device main body.

13. The hog ring clamping device according to claim 12, wherein said power source switch has an overcurrent prevention device.

14. The hog ring clamping device according to claim 12, a push-button type changeover switch, connected to said power source switch, is provided in said clamping device main body, and a push button of said changeover switch projects from said clamping device main body, and wherein a trigger to push said push button is provided.

* * * * *